US007870934B2

(12) United States Patent
Ecker

(10) Patent No.: US 7,870,934 B2
(45) Date of Patent: Jan. 18, 2011

(54) SELF-RETRACTING LANYARD AND BRAKING MECHANISM WITH PAWL LOCKOUT

(75) Inventor: Timothy W. Ecker, Aurora, CO (US)

(73) Assignee: Mine Safety Appliances Company, Pittsburgh, PA (US)

( * ) Notice: Subject to any disclaimer, the term of this patent is extended or adjusted under 35 U.S.C. 154(b) by 918 days.

(21) Appl. No.: 11/485,710

(22) Filed: Jul. 12, 2006

(65) Prior Publication Data

US 2007/0215410 A1 Sep. 20, 2007

Related U.S. Application Data

(60) Provisional application No. 60/782,053, filed on Mar. 14, 2006.

(51) Int. Cl.
*A62B 1/10* (2006.01)

(52) U.S. Cl. ..... 182/239; 182/234

(58) Field of Classification Search ..... 182/231, 182/232, 234, 236, 237, 239
See application file for complete search history.

(56) References Cited

U.S. PATENT DOCUMENTS 3,150,744 A * 9/1964 Fertier ..... 182/239
3,760,910 A 9/1973 Koshihara
4,511,123 A * 4/1985 Ostrobrod ..... 254/364
5,351,908 A * 10/1994 Umezawa et al. ..... 242/383.4
6,224,008 B1 * 5/2001 Smithson et al. ..... 242/374
6,279,682 B1 * 8/2001 Feathers ..... 182/239
6,598,822 B2 * 7/2003 Nagata et al. ..... 242/379.1
7,083,135 B2 * 8/2006 Fleischmann et al. .... 242/382.2
2005/0145435 A1 * 7/2005 Choate ..... 182/3
2006/0137197 A1 * 6/2006 Helda ..... 33/347

FOREIGN PATENT DOCUMENTS

| | | |
|---|---|---|
| FR | 1270109 | 8/1961 |
| GB | 999552 | 7/1965 |
| GB | 2143495 | 2/1985 |
| WO | 2005/108713 | 11/2005 |

* cited by examiner

*Primary Examiner*—Alvin C Chin-Shue
(74) *Attorney, Agent, or Firm*—Nathan J. Prepelka; James G. Uber

(57) ABSTRACT

A self-retracting lanyard having a housing; a rotatable drum in that housing; a line for winding about that drum; and an improved braking mechanism for preventing the drum in that housing from ratcheting due to line rebounding after a fall arrest event. The braking mechanism has a plurality of pawl lockout elements for flexibly engaging with a stationary component of the lanyard to keep at least one pawl in a locked position during reverse rotation of the drum thereby preventing ratcheting from occurring.

9 Claims, 5 Drawing Sheets

SELF-RETRACTING LANYARD AND BRAKING MECHANISM WITH PAWL LOCKOUT

CROSS-REFERENCE TO RELATED APPLICATION

This application claims the benefit of U.S. Provisional Patent Application No. 60/782,053 filed Mar. 14, 2006, the disclosure of which is incorporated herein by reference.

FIELD OF THE INVENTION

The present invention relates to a self-retracting lanyard, or "SRL", intended for mostly industrial uses, but also suitable for certain recreational uses. The invention further relates to the larger family of controlled descent devices, especially those used with a harness to protect their wearers from a sudden, accelerated fall arrest event.

BACKGROUND OF THE INVENTION

Self-retracting lanyards have numerous industrial end uses including but not limited to those for: construction, manufacturing, hazardous materials/remediation, asbestos abatement, spray painting, sand blasting, welding, mining, numerous oil & gas industry applications, electric and utility, nuclear energy, paper and pulp, sanding, grinding, stage rigging, roofing, scaffolding, telecommunications, automotive repair and assembly, warehousing and railroading to name a few. Some tend to be more end use specific than others, like the building/construction system of Franke U.S. Pat. No. 6,695,095; or the roof anchoring system of Ostrobod U.S. Pat. No. 5,730,407.

There are numerous self-retracting lanyards, or lifelines, in the field of fall protection safety equipment. They can and should be worn by an individual when there is any risk of falling. Such self-retracting lanyards generally consist of a housing that includes a rotatable drum or hub around which a lifeline, typically made of webbing, cable or even rope, is wound. The drum rotates in a first direction to unwind (or "pay out") the line from its housing when a certain level of tension is purposefully applied. When that degree of tension is reduced or released, the drum/hub can slowly rotate in a reverse direction causing the line to retract or rewind about itself in a desired manner. Such housings further include a braking mechanism or assembly for stopping drum/hub rotation when the line unwinds too rapidly, i.e., faster than its predetermined maximum velocity for normal pay out. Such sudden line pay outs are an indication that the lanyard wearer/user has experienced a fall that needs to be stopped or arrested.

Should an unintentional, accidental fall commence, the braking mechanism in the housing of the SRL engages. It is meant to stop the SRL wearer from falling too far. After the initial fall has been arrested, the present invention prevents subsequent (typically incremental) line pay outs caused, in part, by the elastic nature of the line itself—in essence, an unintentional, bungee-jumping "rebound" that can place an undue strain on many current lanyard braking mechanisms while possibly jeopardizing the safety/recovery of the SRL wearer as well.

SRL's typically connect at one end to an anchorage point, often on the support structure at or near where a user is performing certain assigned tasks. The line from the SRL housing is clamped (or otherwise attached) to a harness worn by the worker. One representative harness is shown and described in Reynolds et al U.S. Pat. No. 6,804,830, the disclosure of which is incorporated by reference herein.

Known models of SRL's include those disclosed in Schreiber et al U.S. Pat. No. 6,810,99; Wolner et al U.S. Pat. No. 5,186,289, Wolner U.S. Pat. No. 4,877,110 and Wolner et al U.S. application Ser. No. 10/914,631, which published on Mar. 10, 2005 as US20050051659. None of these devices, however, address the issue of line rebounding inhibition to the same degree as the present invention.

It would be desirable, therefore, to develop a self-retracting lanyard with a braking mechanism having a lockout element which prevents the pawl from being released during rebounding.

SUMMARY OF THE INVENTION

Generally, the present invention provides an improved self-retracting lanyard that will stop or arrest a fall event while reducing the risk of rebounding or drum/hub ratcheting. More particularly, the present invention provides an improved braking mechanism for use in a self-retracting lanyard wherein a line (web or cable) is wound around a rotatable drum held in a housing. Such braking mechanisms typically include a plurality of pawls for engaging with a toothed plate (or sperrad) in a first plane of rotation during a fall event. The present invention improves upon existing SRL braking mechanisms by incorporating at least one pawl lockout element, preferably comprising a spring-like deformable material that will flexibly engage with a stationary (i.e. non-rotating) component of the SRL, preferably one or more distal ribs in the housing interior. Preferably, the pawl lockout element is positioned in a plane parallel to the plane containing the pawls of the braking mechanism. A preferred deformable material for the pawl lockout element of the present invention is a small O-ring made from synthetic rubber.

The present invention represents an improvement over known SRL's by keeping its braking mechanism pawl or pawls engaged for an increased duration. Using mechanical means to hold such pawls in place, the present invention actually increases the amount of backward rotation of the drum that is permitted while keeping the braking mechanism locked, nearly doubling the amount of rotation that would be possible by geometrically maximizing the interaction between the pawl and teeth tips of the sperrad plate.

Preferably, the present invention has more than one pawl lockout element for precluding drum ratcheting, i.e., the incremental backward rotation of the drum after an initial fall arrest.

With the advantages and other improvements of the present invention, a plurality of pawl lockout elements keep the pawls of such braking assemblies in a locked position after a fall arrest thereby rendering the SRL wearer/user more safe and secure from post-fall arrest release or rebounding.

BRIEF DESCRIPTION OF THE DRAWINGS

Further features, objectives and advantages of the present invention shall become clearer with respect to the following detailed description of preferred embodiments made with reference to the accompanying drawings in which.

DESCRIPTION OF PREFERRED EMBODIMENTS

Figure 1A:
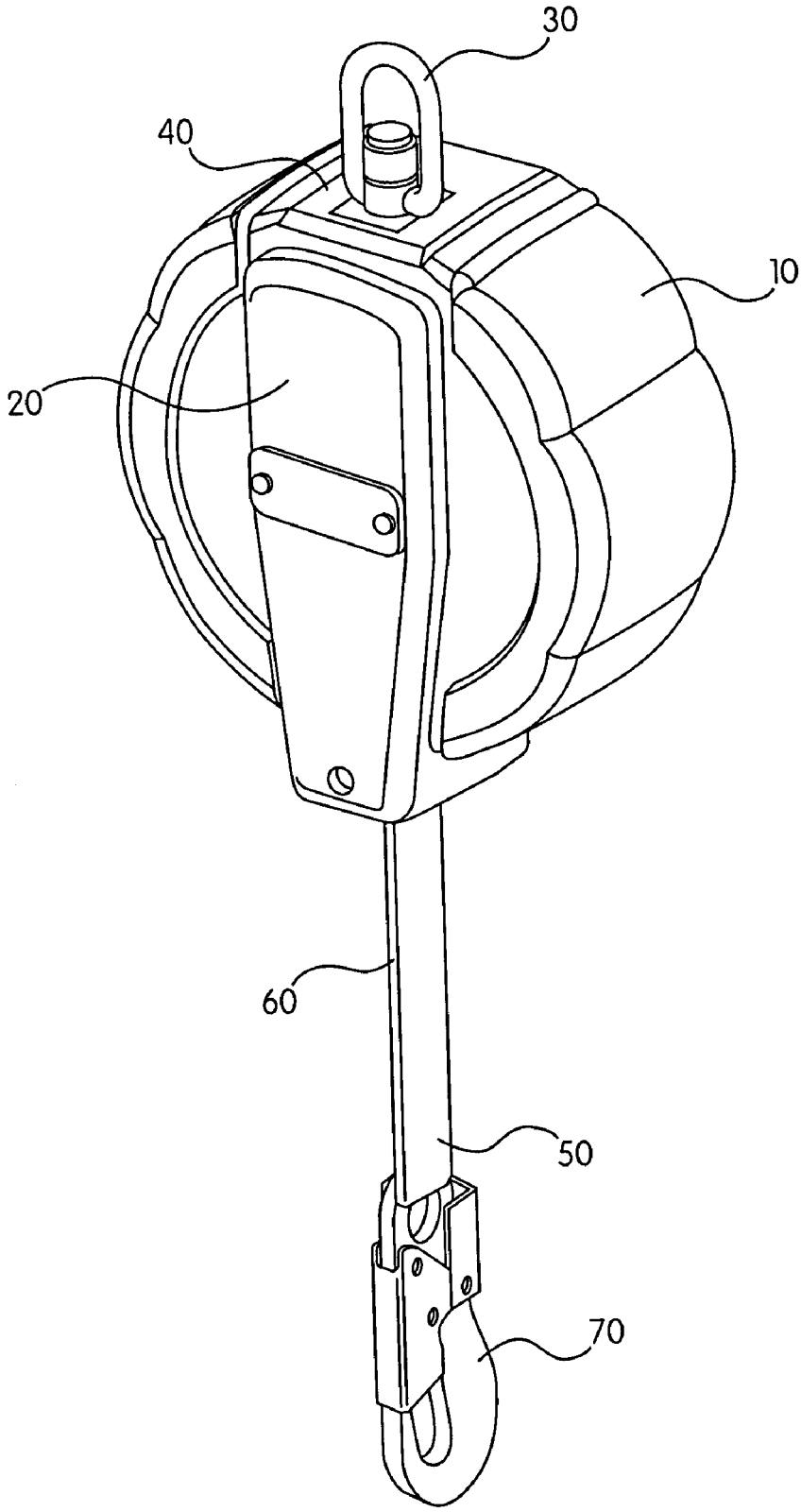
FIG. 1A is a perspective view of a fully assembled, self-retracting lanyard (SRL) having the braking mechanism with the pawl lockout element of the present invention.

Referring now to FIG. 1A, there is shown a typical, self-retracting lanyard fully assembled. The improved braking mechanism with the pawl lockout element of the present invention is internal to that SRL unit and is not visible in that view. But portions of the same are better illustrated in the exploded, partial cutaway of FIG. 1B. Such SRL's include a housing 10 about which is wrapped a cover 20, removable for easier servicing. Housing 10 has at its one end (directionally, at the top of FIG. 1A) an anchor connector 30 for the SRL wearer/user to fasten the unit to an anchorage point. On this particular model, there is further shown a load indicator button 40 for quickly showing that this particular unit has not undergone a fall arrest and, as such, is safe to be used that day.

Below the housing 10 in FIG. 1A, there extends a line 50, in this case made from nylon webbing, though it is to be understood that the braking mechanism of the present invention can also be used with SRL lines made from metal cables and/or rope, all of which can undergo their own degrees of line rebounding. SRL's with drums of wound webbing are preferred in certain situations because they are usually lighter in weight than their cable counterparts. At the lower end of line 50, FIG. 1A shows the stitching 60 that reinforces the connection of line 50 about snaphook 70. It is to be understood, however, that numerous other means are known for connecting SRL units to a wearer's given safety harness.

Figure 1B:
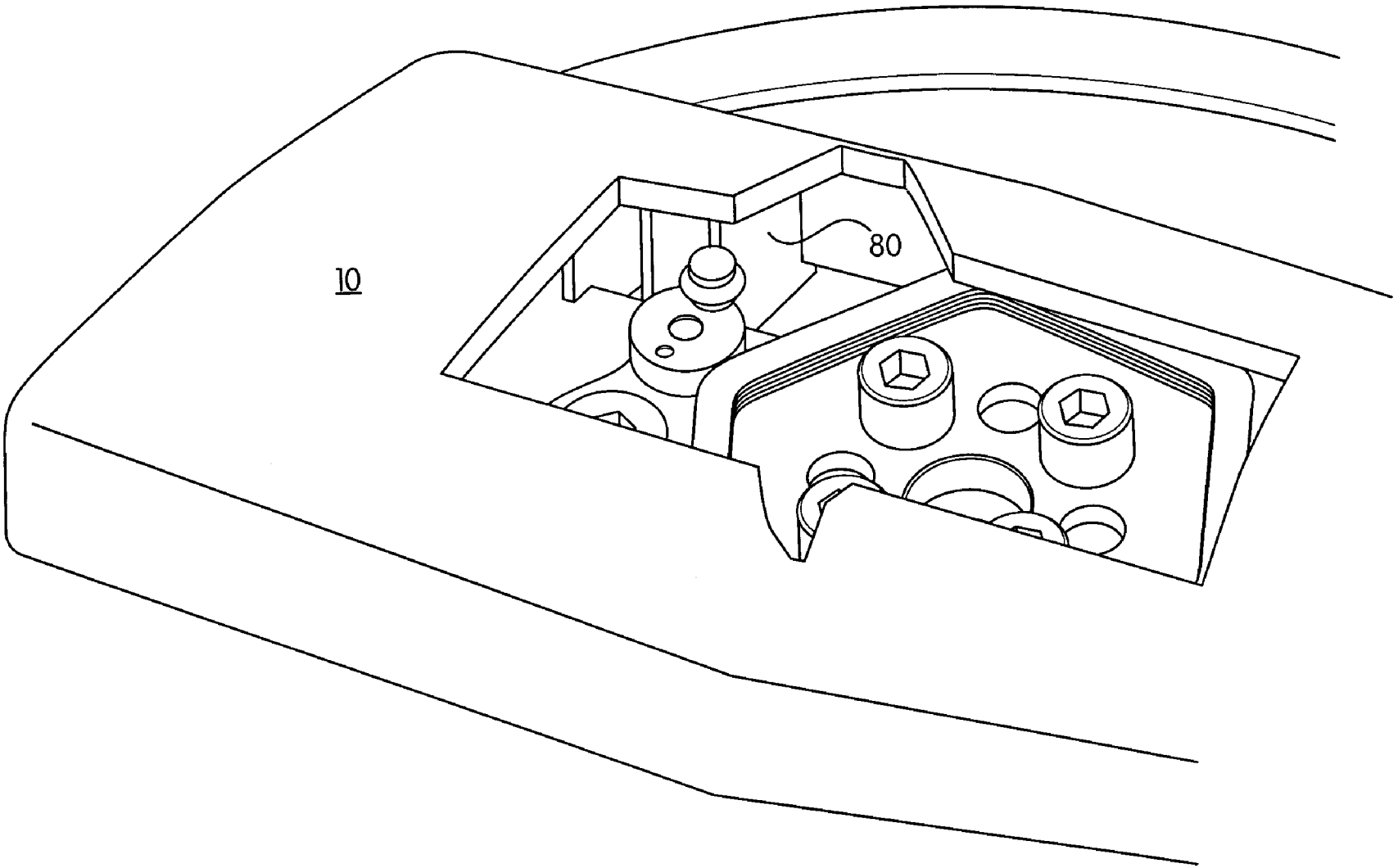
FIG. 1B is an exploded, partial cutaway of the housing from FIG. 1A showing one preferred embodiment of distal ribs extending inwardly from the same.

As can be better seen in FIG. 1B, the interior side walls of housing 10 preferably include a distal rib 80. In this embodiment of the present invention, rib 80 serves as the fixed or stationary contact point for interacting with a preferred pawl lockout element as described in greater detail below. To a lesser extent, distal rib 80 can be supplemented with, or fully replaced by, an inwardly extending protrusion (or post) from the housing front inner wall and/or an upwardly extending post from the overall SRL frame that runs through housing 10. In later figures, portions of that housing frame are depicted as item F where appropriate.

Figure 2:
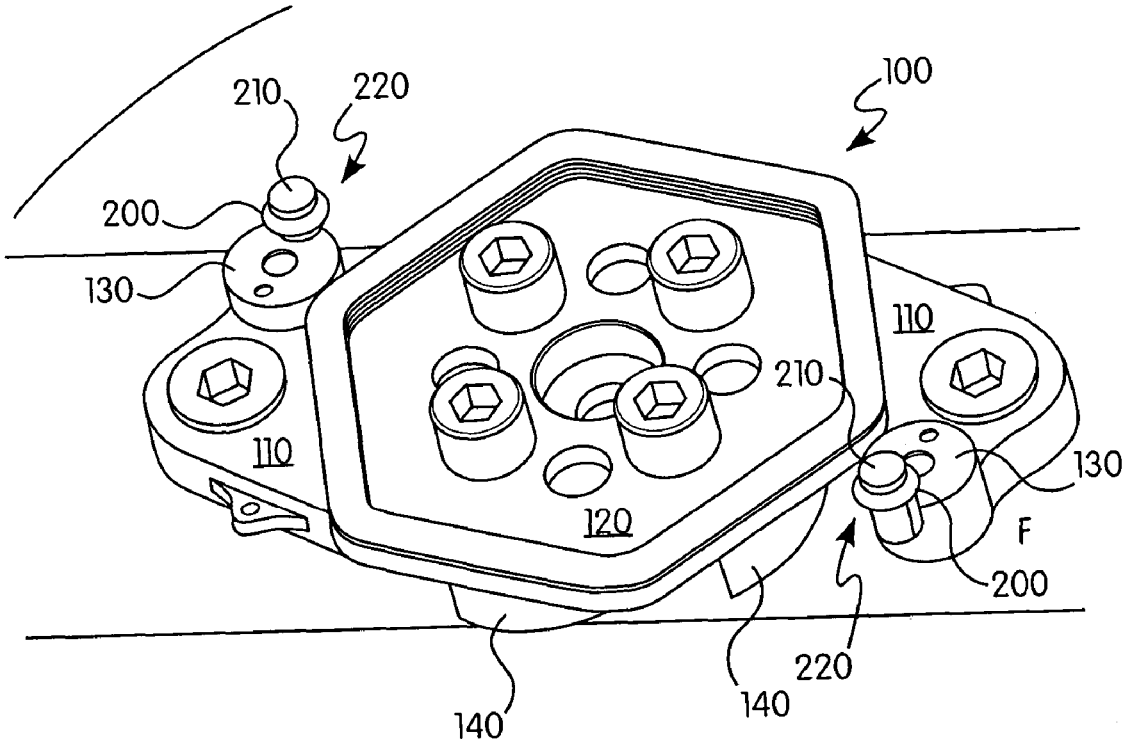
FIG. 2 is a perspective view of one preferred embodiment of a drum braking mechanism of the present invention as would be attached to a stationary housing frame (not fully shown)

Within housing 10 of the SRL, there is contained a braking mechanism 100. Through not fully shown in FIGS. 2 and 3A through 3D, that mechanism preferably consists of a plurality of pawls 110 acting beneath a cam plate 120 for a drum/hub unit (not shown) rotatably attached to housing frame F. Line 50 would be repeatedly unwound from, then rewound about that drum/hub unit in the normal operation of this SRL. In this embodiment of the present invention, there is a cam follower 130 fixedly attached to an end of pawl 110. In FIG. 2, there is shown a pair of pawls 110 and cam followers 130 positioned 180 degrees apart beneath a generally hexagonally-shaped, outer cam plate 120. One embodiment of cam follower 130 is described in greater detail with respect to FIGS. 4A through 4D hereinbelow.

Figure 3A:
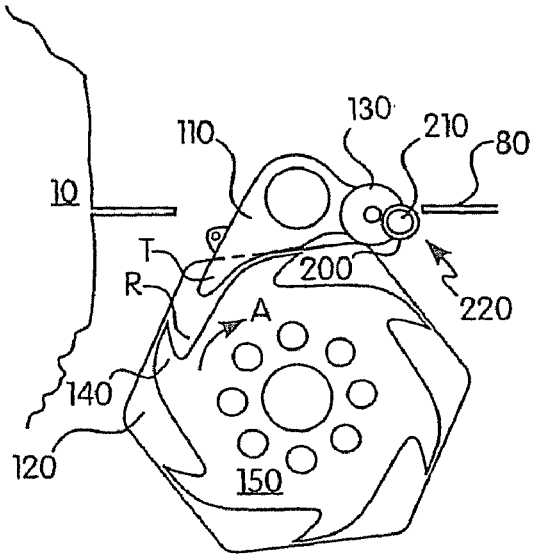
FIGS. 3A through 3C are three views for schematically showing the braking mechanism with pawl lockout element of the present invention: (i) in its normal operating state (FIG. 3A); (ii) in its locked state, engaged with the sperrad teeth after a fall arrest (FIG. 3B), and (iii) in its lockout mode with the lockout element compressed against a distal rib on the housing interior (FIG. 3C)
Figure 3B:
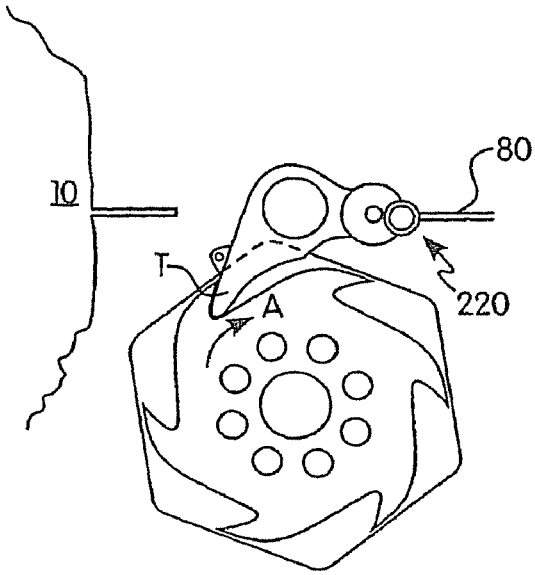
Figure 3C:
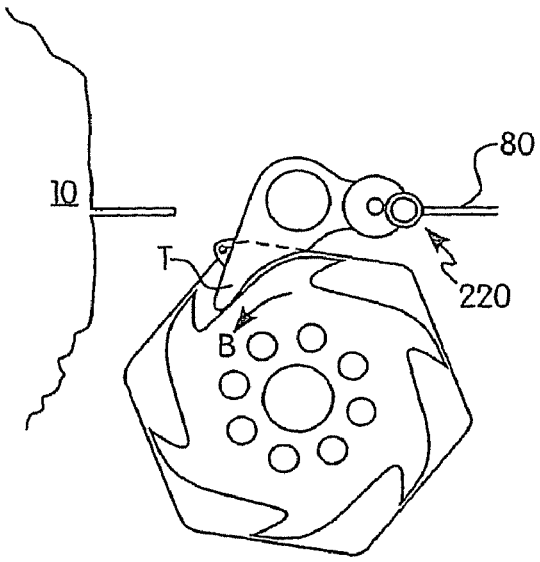

A preferred pawl lockout element 220 of the present invention is shown, in different modes of operation in the three schematic views of FIGS. 3A through 3C. On FIGS. 3A and 3A the typical direction of drum rotation, during web unwinding or pay out from the housing, is indicated by arrow A. FIG. 3A depicts the normal operating condition of a pawl 110 interacting with teeth 140 that extend outwardly from a sperrad 150 that rotates around a central axis mounting, all beneath the confines of outer hexagonal cam plate 120. Cam follower 130 on pawl 110 moves in conjunction with the perimeter of hexagonal cam plate 120 in this SRL braking mechanism. Preferably, pawl lockout element 220 comprises flexible element 200 mounted on a post 210. Flexible element 200 is preferably positioned parallel to the plane of rotation of sperrad 150. For the particular point of rotation depicted in FIG. 3A, there is no contact of flexible element 200 on post 210 mounted on cam follower 130 with the distal rib 80 extending inwardly from a sidewall of housing 10.

Figure 3D:
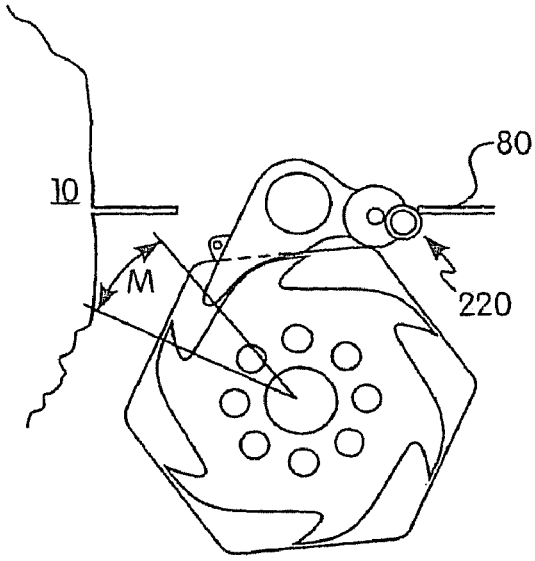
FIG. 3D illustrates the increased angle of reverse rotation that can be sustained with the present invention while still remaining in a locked state.
Figure 4A:
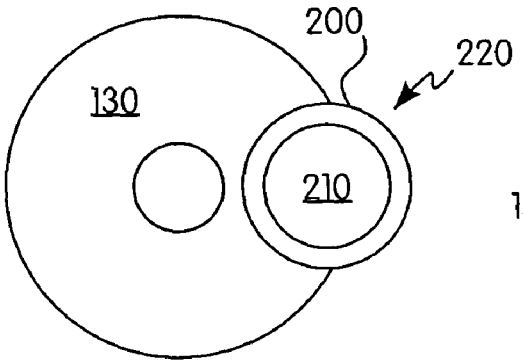
FIGS. 4A through 4D are the top, bottom, side and front view of a preferred embodiment of a pawl lockout element of the present invention mounted on a cam follower.
Figure 4B:
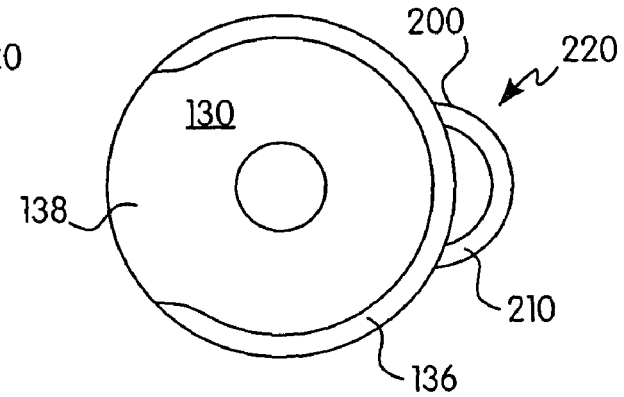
Figure 4C:
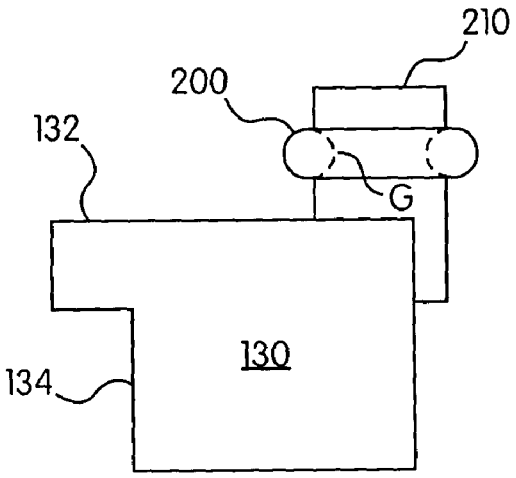
Figure 4D:
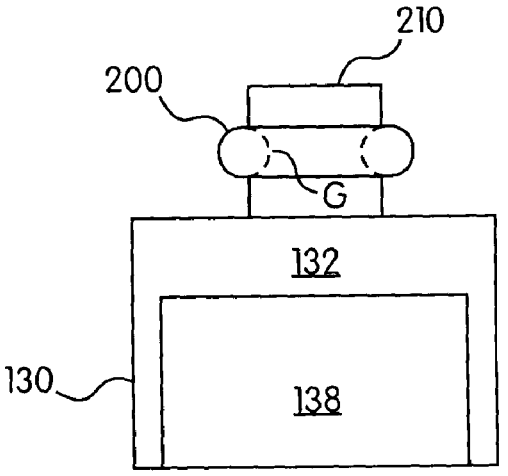

In its second mode of operation (as shown in FIG. 3B), the braking mechanism of the present invention has been activated and is in a first locked position. In such a state, tip T of pawl 110 rests in root R of sperrad 150 adjacent a given tooth 140 of that sperrad. Through the corresponding movement of cam follower 130 mounted on pawl 110, flexible element 200 on post 210 makes contact with distal rib 80. During rebounding, sperrad 150 and cam plate 120 rotate in a reverse direction (indicated by arrow B in FIG. 3C); however, flexible element 200 on post 210 flexibly compresses against distal rib 80 to keep pawl 110 in a locked position relative to sperrad 150. For ease of comparing the relative positions of sperrad 150 and cam plate 120 between FIGS. 3B and 3C, FIG. 3D was included. FIG. 3D better illustrates how the braking mechanism of the present invention is able to increase the maximum permitted rotation of sperrad 150 and thus of the drum to about twenty-eight degrees (angle M), or nearly double the thirteen degree (13°) angle of rotation otherwise achievable by only manipulating relative sperrad tooth and pawl tip geometries to remain in the locked position.

FIGS. 4A through 4D show one preferred embodiment of the pawl lockout element of the present invention from a top view perspective (FIG. 4A), corresponding bottom view (FIG. 4B), side view (FIG. 4C) and front view (4D). In each view, the flexible element 200 (preferably an O-ring) is fully or partially visible on the upwardly, outwardly jutting post 210 which is mounted on cam follower 130. As better seen in FIGS. 4C and 4D, post 210 preferably has a groove G for receiving and holding an O-ring thereon. Preferably, the O-ring is made of a synthetic rubber, more preferably EPDM (an ethylene propylene diene monomer). It is to be understood, however, that other materials can be substituted therefore in order to provide a flexible element for engaging with a stationary component of the SRL unit extending from an interior surface of housing 10 itself and/or from one or more points on the permanent frame F running through the SRL.

In the construction of a preferred cam follower 130, there is a cam following surface 132 positioned above a pawl skirt region 134, the latter serving to hold cam follower 130 in place for flexible element 200 to effectively lockout the pawl in contact with skirt region 134. And as better seen in the bottom and front views of FIGS. 4B and 4D, respectively, cam follower 130 includes a crescent-shaped, lower outer wall 136 that defines a pawl garage 138 that non-rotatably mounts cam follower 130 on one end of pawl 110.

Preferably, each pawl 110 in accompanying FIG. 2 has its own pawl lockout element, which may or may not be interconnected. If the pawl lockout elements are configured to mechanically lock simultaneously, or near simultaneously, the SRL will have an even more desirable safety redundancy built in.

Other embodiments of the present invention use a plurality of pawl lockout elements to keep at least one pawl in a locked position, even during rebound when the drum/hub rotation changes direction. While any such pawl lockout element should be flexible and mounted on pawl 110, still similar improvements can be realized in a centrifugally driven brake/clutch, or in the braking elements of other rotational components. And while presently preferred embodiments depict a sperrad having teeth that extend outwardly from a central axis toward the housing interior walls, it is understood that a similar system of pawls, plates and lockout elements can be easily implemented in the reverse, i.e., for a braking mechanism in which the sperrad plate extends about the braking mechanism circumference before terminating with inwardly extended or protruding teeth.

Pawl lockout elements were comparatively tested using both small and large diameter O-rings wrapped about a post mounted on a cam follower. The smaller rings exhibited slightly better pawl lockout performance with both ring sizes serving to prevent drum ratcheting while not otherwise interfering with the SRL unit's ability to retract webbing under normal operating conditions. Also, regardless of relative size, the pawl lockout elements, in combination with their respective fixed contact points, allow the SRL and braking mechanism of the present invention to meet or exceed all ANSI A10.32 and Z359 standards, and the respective standards of EN and OSHA as well.

Having described presently preferred embodiments, it is: to be understood that the apparatus and methods of the present invention may be configured and conducted as appropriate for a given application. The embodiments described above are to be considered in all respects only illustrative and not restrictive. The scope of the invention is defined by the following claims rather than by the foregoing description. All changes which come within the meaning and range of equivalency of these claims are to be embraced within their scope.

What is claimed is:

1. A self-retracting lanyard having an improved braking mechanism comprising:

(a) a housing;

(b) a rotatable drum in the housing;

(c) a line for winding around the drum; and (d) a braking mechanism comprising: a sperrad; a plurality of pawls for engaging with a plurality of teeth on the sperrad; and at least one pawl lockout element mounted on one of the pawls and spaced from a stationary element mounted in the housing of the lanyard and flexibly engaging the stationary element keeping said one of the pawls in an engageable position during reverse rotation of the drum after initial activation of the braking mechanism, wherein the at least one pawl lockout element comprises a flexible element that is formed from a flexible material.

2. The lanyard of claim 1 wherein the pawl lockout element is located on a cam follower that is attached to the pawl.

3. The lanyard of claim 1 wherein the pawl lockout element comprises an O-ring.

4. The lanyard of claim 1 wherein the stationary element extends from an interior wall of the housing.

5. The lanyard of claim 1 wherein the braking mechanism comprises two pawls spaced 180 degrees apart, and the sperrad has at least four teeth.

6. The lanyard of claim 5 wherein each pawl has its own pawl lockout element.

7. The lanyard of claim 6 wherein each pawl lockout element acts independently of each other.

8. The lanyard of claim 1 where the sperrad has a central axis of rotation with teeth extending outwardly toward an outer circumference.

9. The lanyard of claim 1 wherein the line comprises a webbed material.

* * * * *